US005450654A

United States Patent [19]

Sullivan

[11] Patent Number: 5,450,654

[45] Date of Patent: Sep. 19, 1995

[54] WINDOW STAY

[75] Inventor: Kevin F. Sullivan, Wellington, New Zealand

[73] Assignee: Interlock Industries Limited, Wellington, New Zealand

[21] Appl. No.: 96,307

[22] Filed: Jul. 26, 1993

[51] Int. Cl.[6] ..... E05D 15/32

[52] U.S. Cl. ..... 16/370; 16/362; 16/366

[58] Field of Search ..... 16/362, 363, 366, 367, 16/368, 369, 370, 371; 49/248, 251, 250, 252

[56] References Cited

U.S. PATENT DOCUMENTS

| | | | |
|---|---|---|---|
| 4,674,149 | 6/1987 | Vetter | 16/370 |
| 4,689,852 | 9/1987 | Buckley | 16/363 |
| 4,833,754 | 5/1989 | Yang | 16/369 |
| 4,930,185 | 6/1990 | Hutton | 16/325 |
| 4,961,286 | 10/1990 | Bezubic | 49/175 |

FOREIGN PATENT DOCUMENTS

| | | | |
|---|---|---|---|
| 2148384 | 5/1985 | United Kingdom . | |
| 2225378 | 5/1990 | United Kingdom | 16/370 |
| WO88/00638 | 1/1988 | WIPO | 16/370 |

*Primary Examiner*—Mark Rosenbaum
*Assistant Examiner*—Chuck Y. Mah
*Attorney, Agent, or Firm*—Oblon, Spivak, McClelland, Maier & Neustadt

[57] ABSTRACT

For the mounting of a window sash in a frame, a window stay comprises a frame mounting component and a sash mounting component one or both of which are of die cast construction. A short arm and long arm are pivotally coupled by pivots to the frame and sash mounting components. A head lock of a head locking mechanism is carried by sash mounting component and is laterally offset to the length of the sash mounting component. The head lock engages with a head stop, which projects from the frame mounting plate, via engagement surfaces when the stay is moved to a position which corresponds to the closed position of a window.

9 Claims, 4 Drawing Sheets

WINDOW STAY

BACKGROUND OF THE INVENTION

Discussion of the Background

This invention relates to a window stay.

Stays for the adjustable mounting of a window sash in a window frame traditionally have mounting plates and an arm or arms constructed from steel (more particularly stainless steel) and/or a suitable aluminium alloy. Market requirements and/or regulatory demands have led to such window stays incorporating separate componentry mounted or associated with the mounting plates and/or arms to achieve required in use functions. For example, there is a need for the hinge side of a window sash to be secured, when the window is fully closed, to resist opening under negative pressure conditions or more particularly due to leverage arising from unauthorized forced entry. However, the necessary resistive or "head locking" functions cannot always be achieved with componentry mounted or associated with the main components of the stay.

Also the main components of the stay must exhibit the necessary strength and/or rigidity characteristics to meet in use demands. This is often achieved by configuring the or some of the main components such as to achieve these end requirements. This can lead to more complicated manufacturing steps or processes, wastage of material, high demands on quality control procedures and the like.

SUMMARY OF THE INVENTION

The prime object of the present invention is to provide a window stay having one or more components constructed such that greater versatility of design to meet end use criteria can be achieved.

Accordingly in one broad aspect of the invention there is provided a window stay comprising at least frame and sash mounting components and an arm component the stay being characterized in that at least one of such components is of die cast construction.

In a preferred form of the invention at least one of the frame and sash mounting components is of die cast construction and has integrally formed therewith an element which forms part of a head locking mechanism. Preferably, however, both the frame and sash plate components are of die cast construction and have integrally formed therewith components of the head locking mechanism.

DESCRIPTION OF THE PREFERRED EMBODIMENTS

Figure 1:
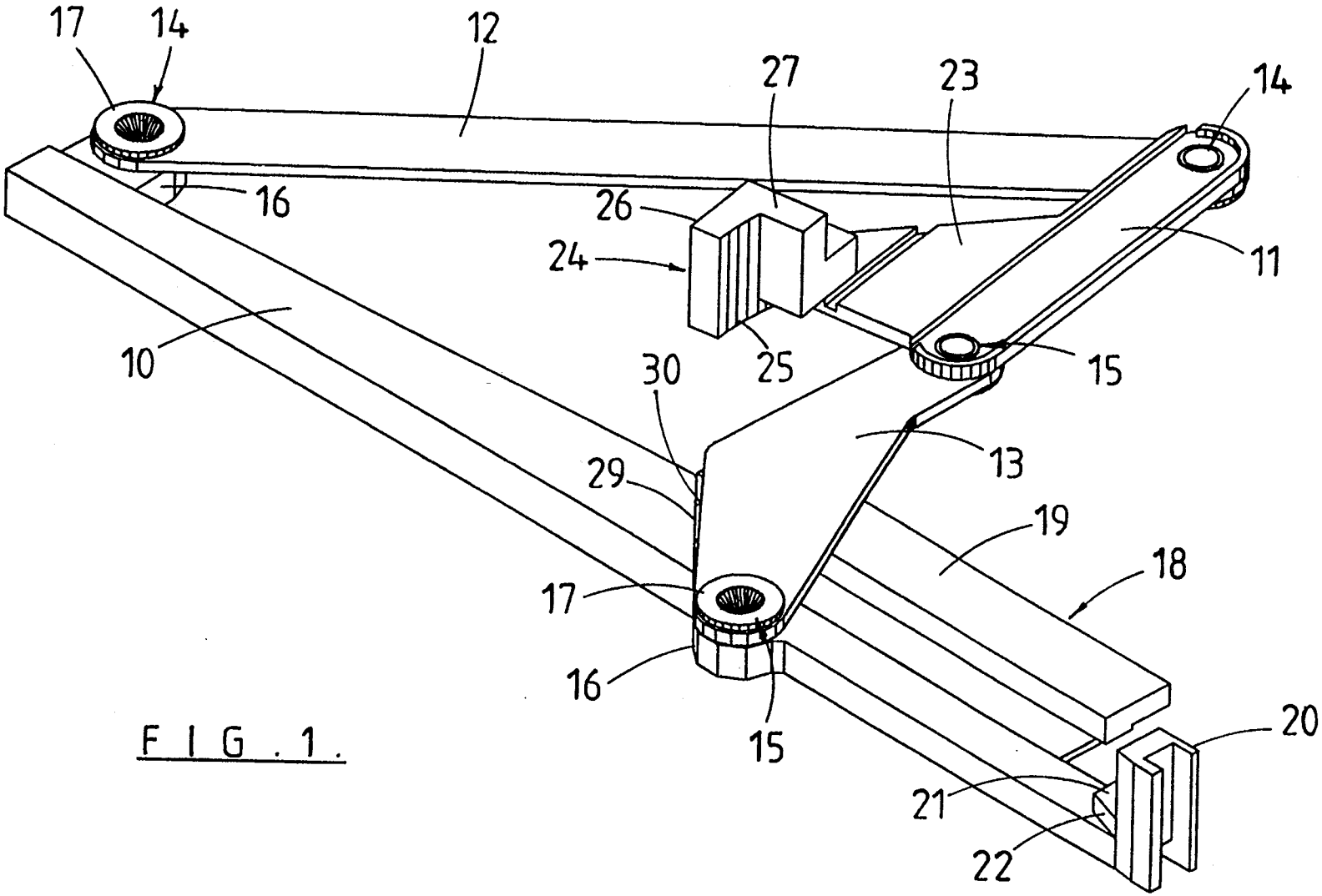
FIG. 1 is a perspective view of the stay in a fully open position.

The stay according to the illustrated preferred form of the invention comprises a frame mounting plate 10 and a sash mounting plate 11 both of which are preferably of one piece die cast construction. The frame mounting plate 10 is adapted to be mounted with a window frame F (FIGS. 5 and 6) and the sash mounting plate 11 is adapted to be mounted with a window sash S.

Coupling the frame and sash mounting plates together is a long arm 12 and a short arm 13. Arm 12 is pivotally coupled via pivot bearings 14 to respective ends of frame plate 10 and sash plate 11. Arm 13 is coupled to the frame plate 10 and sash plate 11 via bearings 15. As illustrated pivot mounts 14 and 15 coupling the arms to frame plate 10 are located on projecting or bulbous portions 16 formed integrally with the frame plate. Thus the axes of these pivot bearings 14 and 15 are offset to either side of a longitudinal axis or main body of frame plate 10.

In the preferred form of the invention arms 12 and 13 are constructed from stainless steel. Also according to the preferred form of the invention the pivot bearings 14 and 15 are of a friction type and preferably are of a construction of the type as disclosed in New Zealand patent specification 230905. As a consequence cast frame and sash plates 10 and 11 have spigots (i.e. annular boss forms) cast into them and these spigots engage in openings in the arms 12 and 13. Headed fasteners 17 extend into the annular spigots and are located against axial movement therein. As disclosed in patent specification 230905 a plastics material is located in the pivot to prevent metal to metal contact where one metal surface moves relative to another metal surface.

Preferably headed fasteners 17 are hollow thus mechanical fastenings can pass therethrough for fixed mounting of the mounting plates 10 and 11 to the window frame F and sash S.

Preferably an arm support (shown generally at 18) is provided with frame plate 10. In the preferred form of the invention this support is formed by a mounting (not shown) cast integrally with the frame plate and with which is mounted a plastics material pad. The support pad 18 thus provides a planar surface 19 with which the underside of short arm 13 slidingly engages. In an alternative arrangement the pad 18 can overlie a part of mounting plate 10 and be fastened thereto.

Located at the end of the frame plate 10 which is adjacent to pivot mount 15 of short arm 13 is a head stop in the form of an upstand 20. A land 21 extends from upstand 20 toward short arm 13. Upstand 20 and land 21 are formed integrally with frame plate 10. The edge surface of land 21 which is located toward the side of frame plate 10 adjacent pivot 15 and the corresponding side of upstand 20 is formed such as to provide a curved surface 22 which can be more clearly seen in FIG. 2.

Projecting laterally from sash plate 11 is a flange 23. A head lock 24 is located at the outer extremity of flange 23. This head lock 24 as can be seen from FIG. 1 is of generally L shape with the leg 26 of the L shape providing a curved surface 25. This curved surface 25 actually extends under the foot 27 of the L shape as can be seen in FIG. 1 and in dotted detail in FIG. 2. Flange 23 and head lock 24 are preferably formed integrally with sash plate 11. The head lock 24 is thus, as shown, laterally offset from sash plate 11.

Figure 2:
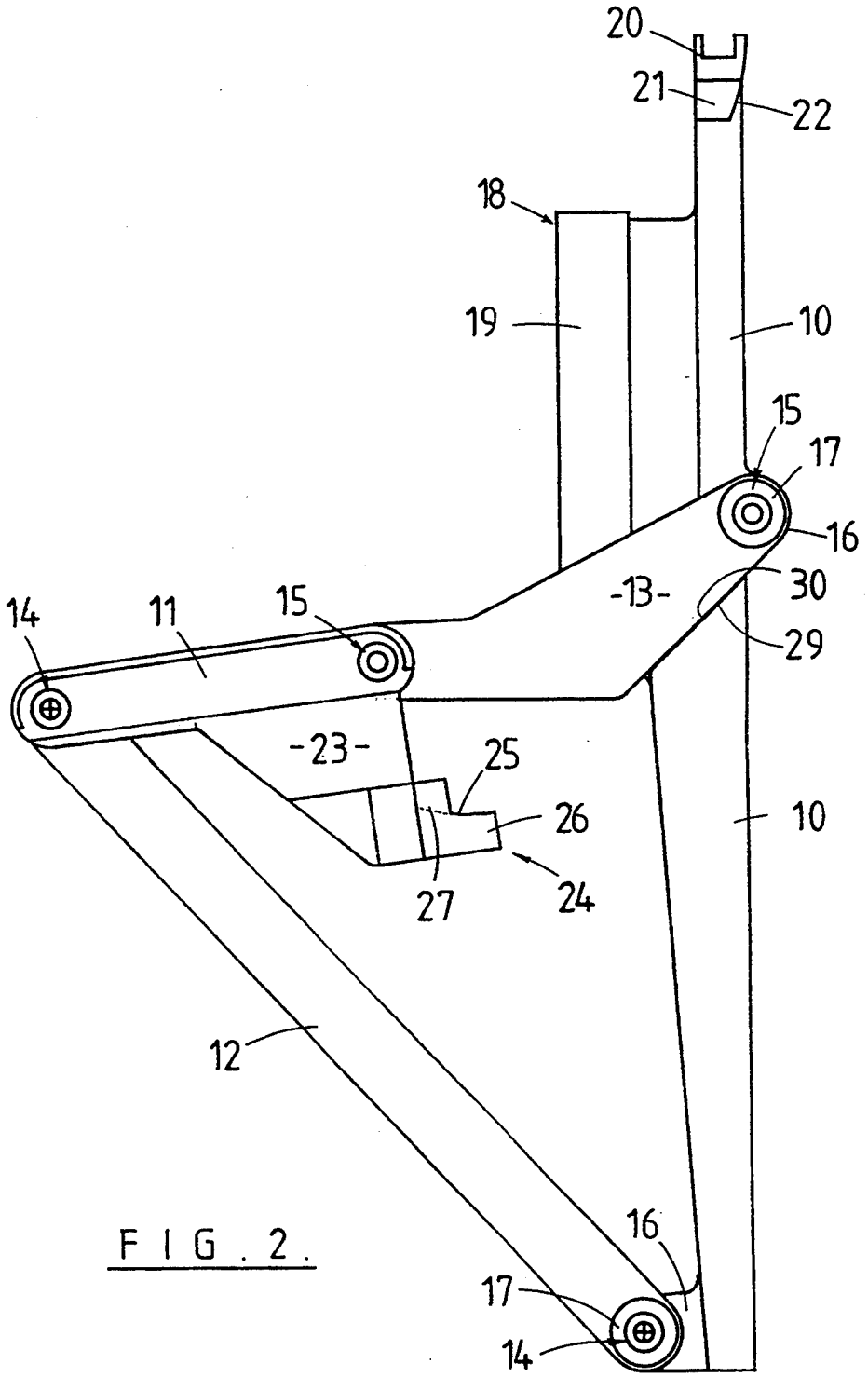
FIG. 2 is an elevation view of the stay in its fully open position.

Integrally formed with frame plate 10 is a stop 29. This stop 29 is effectively an inclined surface formed by the length of the frame plate 10 being of increased thickness as can be seen more clearly in FIG. 1. Thus edge 30 of short arm 13 engages with incline surface 29 when the stay is in its fully opened position as shown in FIGS. 1 and 2.

The stay according to the present invention is primarily intended as use as a casement stay. Hence desirable support for the short arm 13 is provided by the short arm support 18.

Figure 6:
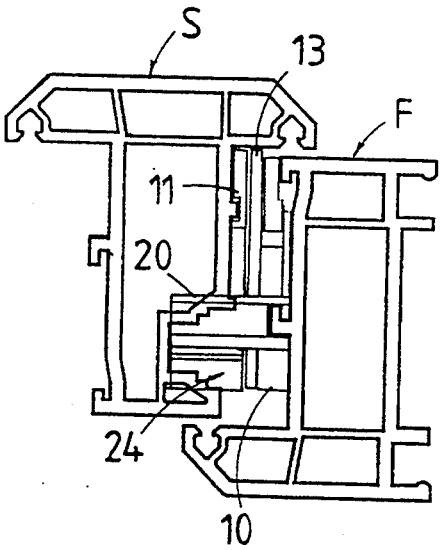
FIG. 6 is an end elevation of the arrangement shown in FIG. 5.
Figure 5:
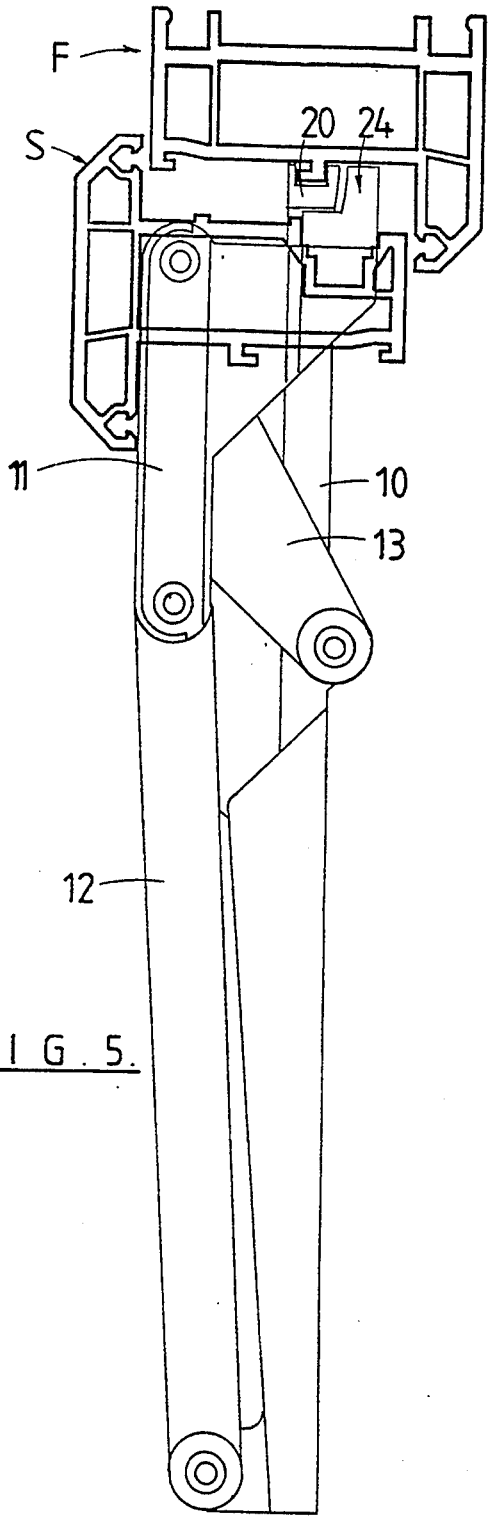
FIG. 5 is an installation view in elevation with the stay in a fully closed position.

A stay constructed according to the present invention is able to utilize the full space of the cavity defined by the frame and sash of the window as more clearly shown in FIGS. 5 and 6. Thus if the cavity is of a nominal size 50 mm×13 mm the full extent of the 50 mm cavity can be utilized. As a result the stay is able to achieve an open angle of 80° which provides a cleaning allowance at the head of the sash of 100 mm without risk of damage to the sash seal at the fully open position.

Figure 4:
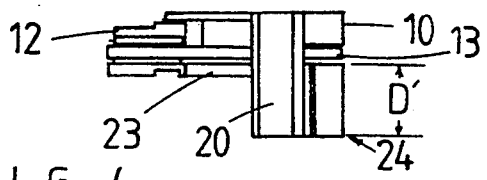
FIG. 4 is an end elevation in the closed position.

As the stay moves from an open position (FIGS. 1 and 2) to a fully closed position (FIGS. 3 and 4) leg 26 of the head lock 24 moves in behind the head stop formed by upstand 20 and land 21 with the result that curved surface 25 comes into mating contact with curved surface 22. Once again due to the stay being able to utilize the full available depth of the cavity the head lock mechanism can include mating surfaces (i.e. curved surfaces 22 and 25) which are compatible. Both surfaces can thus be arcuate and as a consequence can be of the same radius so that when in contact stresses are evenly distributed.

Figure 3:
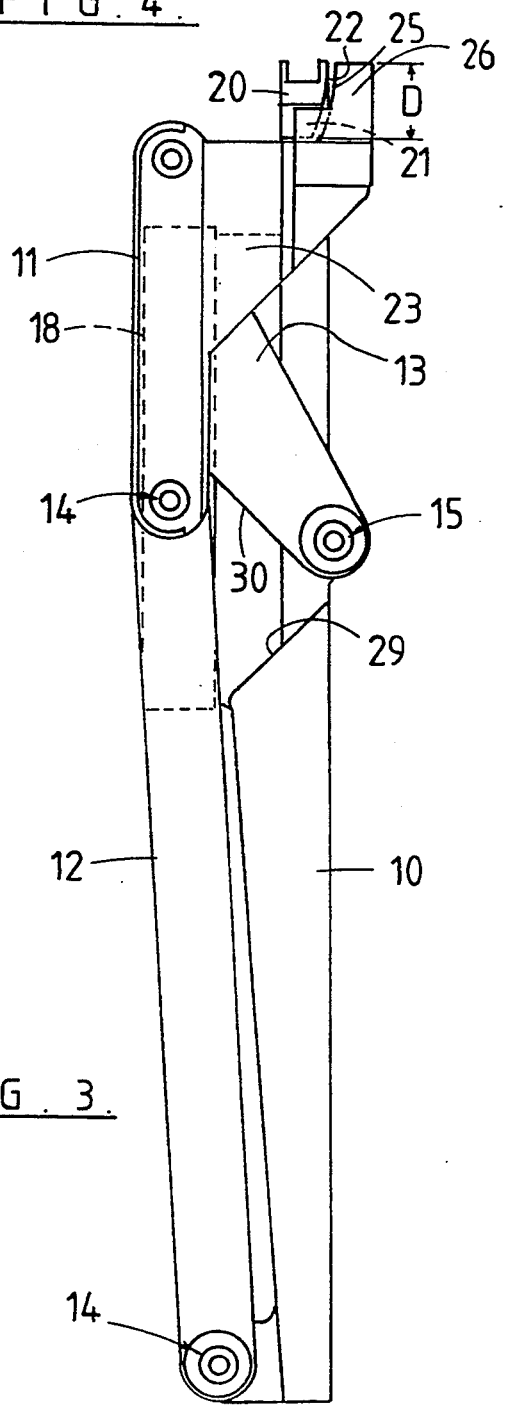
FIG. 3 is an elevation view of the stay in its closed position.

The head lock mechanism exploits the fact that the geometry of the stay provides a final closing action of the sash such that it pivots about the hinge side seal. The geometry provides a closing action which results in the sash plate 11 being located at an angle to long arm 12 when in the fully closed position. This is shown in FIG. 3 where the positioning of head lock 24 relative to upstand 20 can be clearly seen. Thus the head locking mechanism is located at the rear of the cavity and this makes it possible to achieve good engagement between the two compatible surfaces 22 and 25. For example, with a stay of the type illustrated an interengagement in the fully closed position of 15 mm can be achieved, i.e. dimension D.

In addition by fully utilizing the width of the cavity, i.e. the dimension of the cavity perpendicular to the plane of the stay, it is also possible to obtain a good length of engagement between the head lock 24 and head stop. Yet again with the arrangement as illustrated 15 mm of engagement perpendicular to the plane of action of the stay is achieved, i.e. dimension D'.

Consequently the head lock mechanism provides significant and positive engagement between the head lock 24 and the head stop formed by the upstand/land combination especially in the direction perpendicular to the plane of the stay. The extent of engagement represented by dimension D' is significantly greater than that achievable by known stay designs. Consequently any negative pressure, but more particularly any pressure applied by someone trying to achieve forced entry to the hinged side of the sash, will be positively counteracted by the head lock arrangement. When the stay is used with uPVC windows this positive inter-engagement largely overcomes any possibility of forced entry being achieved due to flexing of the window frame/-sash.

What is claimed is:

1. A window stay comprising a frame mounting component, a sash mounting component coupled to the frame mounting component and being moveable relative thereto, a first arm having a first end pivotally coupled to said frame mounting component and a second end pivotally coupled to said sash mounting component, at least said sash mounting component being of a die cast construction, said sash mounting component having integrally formed therewith a head lock element and said frame mounting component having a head stop associated therewith, whereby the head lock element engages with the head stop when the window stay is moved to a closed position, said head lock element being offset laterally to one side of the sash mounting component and said head stop having an engagement surface with which the head lock element engages when the window stay moves to the closed position, and wherein said engagement surface is disposed adjacent to a first side of the frame mounting component and said first side is opposite to a second side of said frame mounting component, and wherein the sash mounting component is adjacent to said second side when the window stay is in the closed position.

2. A window stay as claimed in claim 1, wherein the sash mounting component is coupled to the frame mounting component by a second arm having a shorter length than said first arm, the shorter second arm and the longer first arm each being pivotally coupled at one end to said sash mounting component and at another end to said frame mounting component, said head lock element being disposed at a position laterally spaced from said sash mounting component and adjacent a pivot coupling of said second arm to the sash mounting component.

3. A window stay as claimed in claim 2, wherein said head lock element includes an engagement surface which is engageable with said engagement surface of the head stop, each of the engagement surfaces being arcuate and having a substantially same radius of curvature.

4. A window stay as claimed in claim 3, wherein the head lock element is disposed on a flange which extends laterally from a side edge of the sash mounting component, the engagement surface of the head lock element being formed as part of a projection which extends transversely to the flange.

5. A window stay as claimed in claim 4, wherein the head stop includes an upstand, with a first part of the engagement surface of the head stop formed on the upstand, and wherein a second part of the engagement surface of the head stop is formed on a land extending from the upstand.

6. A window stay comprising a fame mounting component, a sash mounting component, first and second arms, said second arm being shorter than said first arm, each of the first and second arms being pivotally coupled at an end thereof to the sash mounting component at spaced apart pivot locations on the sash mounting component, the first and second arms each being pivotally coupled at another end thereof to the frame mounting component at spaced apart pivot locations of the frame mounting component, the frame and sash mounting components having a die cast construction, said frame mounting component including a support providing a sliding surface with which the second arm is engageable during at least part of an opening or a closing movement of the window stay, each of the frame and sash mounting components including a head lock element of a head lock mechanism which is formed as an integral part of the respective frame and sash mounting components, the head lock element of the head lock mechanism which is formed as part of the sash mounting component being offset laterally to one side of the sash mounting component and the head lock element formed as part of the frame mounting component includes an engagement surface with which the head lock element of the sash mounting component engages when the window stay moves to a closed position, said engagement surface facing a first side of the frame mounting component, wherein said first side is opposite to a second side of the frame mounting component, and wherein the sash mounting component is adjacent to said second side when the window stay is in the closed position.

7. A window stay as claimed in claim 6, wherein a plastics material is applied to the sliding surface.

8. A window stay as claimed in claim 6, wherein at least one pivot coupling between one of the frame and sash mounting components and one of said first and second arms is formed by an integrally cast annular boss which extends into an opening of said one of said first and second arms, and wherein a headed fastener extends into the annular boss and is disposed in said annular boss such that axial movement of the headed fastener is prevented.

9. A window stay as claimed in claim 2 or 6, wherein the frame mounting component has integrally formed thereon a surface which engages with a side edge of the second arm to limit movement of the second arm when the window stay reaches a fully open position.

* * * * *